US008218985B2

(12) United States Patent
No

(10) Patent No.: US 8,218,985 B2
(45) Date of Patent: Jul. 10, 2012

(54) IMAGE PRINTING METHOD WITH REDUCED BANDING

(75) Inventor: Young No, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 40 days.

(21) Appl. No.: 12/751,011

(22) Filed: Mar. 31, 2010

(65) Prior Publication Data

US 2011/0243587 A1 Oct. 6, 2011

(51) Int. Cl.
*G03G 21/00* (2006.01)

(52) U.S. Cl. ..... 399/34

(58) Field of Classification Search ..... 399/43
See application file for complete search history.

(56) References Cited

U.S. PATENT DOCUMENTS 5,333,040 A * 7/1994 Imamiya ..... 399/281
6,459,859 B1 10/2002 Regelsberger et al.
6,885,833 B2 4/2005 Stelter et al.
2005/0162681 A1 7/2005 Ng et al.
2008/0069600 A1 3/2008 Nakamura et al.

FOREIGN PATENT DOCUMENTS

JP 2004 109980 A 4/2004
JP 2005 221829 A 8/2005
JP 2005338348 A * 12/2005

* cited by examiner

*Primary Examiner* — Kiho Kim
(74) *Attorney, Agent, or Firm* — Christopher J. White

(57) ABSTRACT

Cross-track banding artifacts and wear in an electrophotographic (EP) print engine are reduced. A development member and a supply member are disposed so that charge is transferred between them in a charge-transfer region. The members are retained in a first position with respect to each other for a first dwell time, and neither member is rotated during the first dwell time, so that charge is transferred between members in the charge-transfer region. One of the members is rotated so that at least one point on one of the members is moved out of the charge-transfer region. The members are retained in a second position with respect to each other for a second dwell time that is greater than the time for one revolution of the development member, wherein neither member is rotated during the second dwell time.

18 Claims, 9 Drawing Sheets

IMAGE PRINTING METHOD WITH REDUCED BANDING

FIELD OF THE INVENTION

This invention pertains to the field of electrophotographic printing and more particularly to reducing nonuniformities in prints.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, toner particles are given a charge substantially opposite to the charge of the latent image, and brought into the vicinity of the photoreceptor so as to be attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan or process direction. This is typically the vertical (Y) direction of a portrait-oriented receiver. The direction perpendicular to the slow-scan direction is referred to as the fast-scan or cross-process direction, and is typically the horizontal (X) direction of a portrait-oriented receiver. "Scan" does not imply that any components are moving or scanning across the receiver; the terminology is conventional in the art.

Various EP printers, especially low-cost, low- to medium-volume, cartridge-based printers using mono-component toner exhibit banding artifacts in low-frequency areas such as sky. These artifacts appear in a repeating pattern, and extend in the fast-scan direction.

One scheme to reduce banding is to separate supply and toning members in the printer when not printing. However, this adds cost and complexity to the printer. Additionally, this scheme requires maintaining precise alignment and consistent pressure between and across the lengths of the supply and toning members over many cycles of printing and idling between print jobs.

Another scheme to reduce banding is to rotate the supply and toning members on a fixed schedule. However, over time, this causes unnecessary wear on the supply and toning members and the photoreceptor and consumes energy. Moreover, this scheme causes increased levels of toner stress, which itself exacerbates the appearance of banding artifacts. "Toner stress" is physical and electrical changes to the toner particles, which changes are caused by repeated physical contact and mechanical pressure applied to the toner particles such as being repeatedly removed and returned to the toner supply container. For example, toner particles deform and fracture, and surface treatments, designed to enhance and regulate electrical charging, wear off. All of these factors reduce image quality.

There is a continuing need, therefore, for a way of reducing banding artifacts that maintains image quality and low cost, and reduces toner stress.

SUMMARY OF THE INVENTION

According to the present invention, there is provided a method of reducing cross-track banding artifacts and wear in an electrophotographic (EP) print engine adapted to print one or more image(s) on one or more receiver(s), the method comprising:

a) providing a development member and a supply member disposed so that charge is transferred between the members in a charge-transfer region; and performing the following steps in order:

b) retaining the members in a first position with respect to each other for a first dwell time that is greater than a time for one revolution of the development member, wherein neither member is rotated during the first dwell time, so that charge is transferred between members in the charge-transfer region and a cross-track banding artifact is produced on the development member;

c) rotating one of the members so that at least one point on one of the members is moved out of the charge-transfer region, whereby the banding artifact is mitigated; and d) retaining the members in a second position with respect to each other for a second dwell time that is greater than the time for one revolution of the development member, wherein neither member is rotated during the second dwell time, so that wear on the EP print engine is reduced.

An advantage of this invention is it reduces banding artifacts to maintain image quality. It does not require expensive hardware components such as additional motors or actuators, so it is a low-cost solution. It does not cause as much toner stress as prior schemes.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
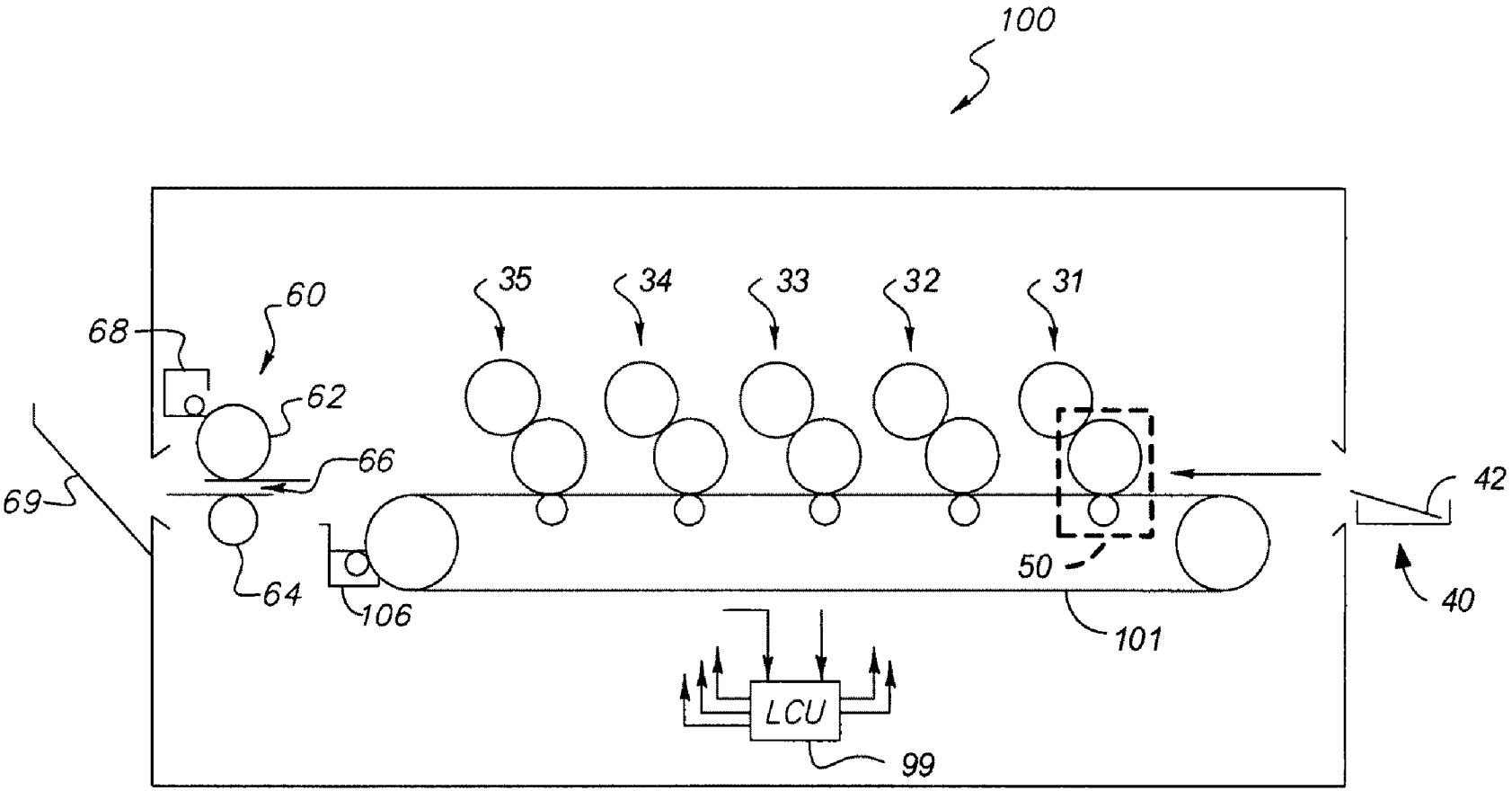
FIG. 1 is an elevational cross-section of an electrophotographic reproduction apparatus useful with this invention.

The attached drawings are for purposes of illustration and are not necessarily to scale.

DETAILED DESCRIPTION OF THE INVENTION

As used herein, the terms "parallel" and "perpendicular" have a tolerance of ±10°.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made sequentially in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for the transfer to the receiver of individual print images. Of course, in other electrophotographic printers, each print image is directly transferred to a receiver.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-section showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to a receiver. The receiver is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner.

Subsequent to transfer of the respective print images, overlaid in registration, one from each of the respective printing modules 31, 32, 33, 34, 35, the receiver is advanced to a fuser 60, i.e. a fusing or fixing assembly, to fuse the print image to the receiver. Transport web 101 transports the print-image-carrying receivers to fuser 60, which fixes the toner particles to the respective receivers by the application of heat and pressure. The receivers are serially de-tacked from transport web 101 to permit them to feed cleanly into fuser 60. Transport web 101 is then reconditioned for reuse at cleaning station 106 by cleaning and neutralizing the charges on the opposed surfaces of the transport web 101.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers carrying the fused image are transported in a series from the fuser 60 along a path either to a remote output tray 69, or back to printing modules 31 et seq. to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for imaging substrates. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R) respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, by Peter S. Alexandrovich et al., and in U.S. Publication No. 2006/0133870, published on Jun. 22, 2006, by Yee S. Ng et al., the disclosures of which are incorporated herein by reference.

Banding artifacts typically appear to have a magenta/cyan coloration due to the human eye's sensitivity to these colors, especially when compared to yellow. Causes of these artifacts include temporary deformation of the supply and toning members, and tribo-electric charge bleeding from the temporarily deformed area of the toning member. This temporary deformation is caused by long periods (hours to days) of inactivity. In various embodiments, the supply member is coated with an open-celled sponge-like material that holds an over-supply of toner to be provided to the toning member. The supply member is very compliant and readily deformed. The toning member is electrically conductive and picks up toner from the supply member. Contact between the members also causes the toning member to experience localized tribo-charge bleeding in the contact area, also contributing to the banding artifact.

Figure 2:
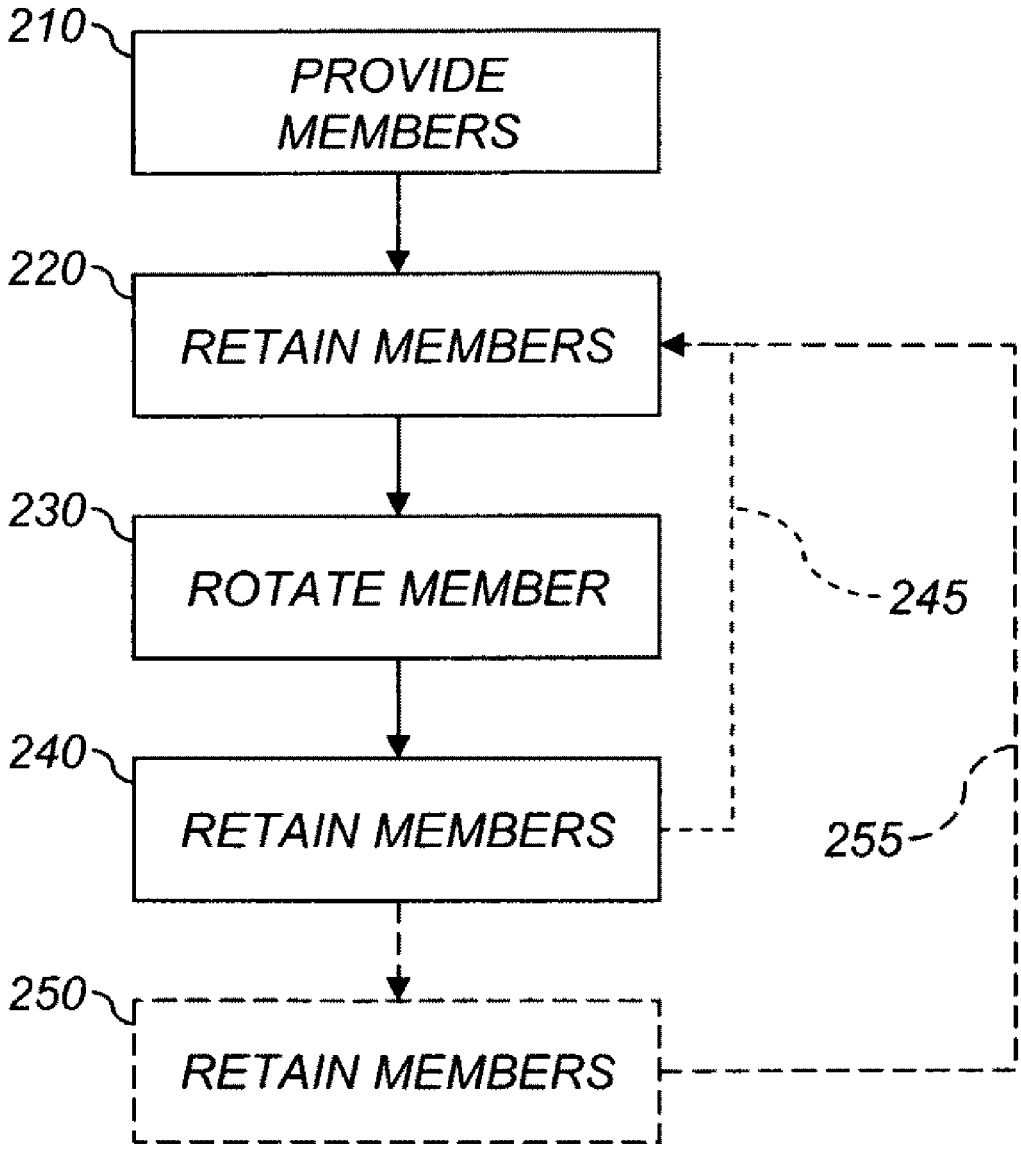
FIG. 2 is flowchart of an embodiment of the present invention.

FIG. 2 shows a flowchart of a method of an embodiment of the present invention. This method reduces cross-track banding artifacts and wear in an electrophotographic (EP) print engine adapted to print one or more image(s) on one or more receiver(s). "Cross-track" banding artifacts are those having a best-fit ellipse with a major axis oriented ≦45° from the fast-scan direction of printer 100 (FIG. 1). "Images" can be pictures, text, test patterns, textured patterns, or any other print images deposited on the receiver. The receiver can be a planar medium, e.g. a piece of paper.

In step 210, a development member and a supply member are provided. They preferably are substantially circular in cross-section, and can be conical or cylindrical. They are disposed so that charge is transferred between them in a charge-transfer region. Charge transfer occurs at various rates throughout the life of the printer. For example, when printing, the rate is very high because toner is moving between the members, and when not printing, the rate is low. Charge transfer rates also depend on bias voltages applied to the members, as is known in the art. In an embodiment, when printing, the toner particles are negatively-charged, and the development member is biased to a negative voltage. Charge transfer can include electron transport, ion transport, and other forms of charge diffusion. When not printing, bias voltages are removed. However, the toner particles are still charged (since they were tribocharged before). The electric field due to the charged toner in the charge-transport area causes charge on the development and supply members to move, resulting in nonuniform charge on the surfaces of the development and supply members. This will be discussed further below with respect to FIG. 4.

Steps 220 through 240 are performed in order to reduce banding artifacts. In step 220, the development and supply members are retained in a first position with respect to each other. The first position includes the location and orientation of both members with respect to a coordinate frame containing both. The members are retained in position for a first dwell time that is greater than a time for one revolution of the development member at its normal process speed while printing, and preferably approximately one hour. Neither member is intentionally rotated during the first dwell time, but small variations in position of ±2% or variations in orientation and rotation of up to ±2° can occur.

While the members are retained in position, charge is transferred between the members in the charge-transfer region and a cross-track banding artifact is produced on the development member, as will be described further below with reference to FIG. 4A. This charge transfer is not desirable, as it produces artifacts, but it is a consequence of the unequal distribution of charges on two objects held in proximity. In an embodiment, the first dwell time corresponds to an idle time of printer 100 after completing a print job (e.g. after finishing the last page of a document).

In step 230, one of the members is rotated so that at least one point on one of the members is moved out of the charge-transfer region. The point moved out of the region can be on the rotating member or the stationary member. Both members can rotate, or just one. Preferably, both members are rotated approximately 30°. The rotation mitigates the banding artifact by moving the charged toner with respect to the members. Therefore, the electric field of the charged toner exerts a force on charges in a different area of the members, and so redistributes charge. For example, during the first dwell time, the electric field due to the negative toner charges can push negative charge out of the charge-transfer region. After the rotation, the same field can push the charge back into the charge-transfer region.

In step 240, the members are retained in a second position with respect to each other for a second dwell time. The second position is different from the first position. This permits the electric field to redistribute charges, as described above. The second dwell time is greater than the time for one revolution of the development member at normal process speed, and neither member is rotated (within the tolerances described above) during the second dwell time. This reduces wear on the EP print engine, and reduces toner wear. Steps 220-240 can be repeated one or more times (loop 245). In an embodiment, the second dwell time corresponds to an idle time of printer 100 before beginning a print job. Steps 220-240 are preferably repeated whenever printer 100 is idle between print jobs, and more preferably a sufficient amount of time to dissipate substantially all of the residual charge on the toner and members, so that the remaining charge does not cause visible banding artifacts when the members are left in contact. Stopping rotation after the charge is substantially dissipated advantageously reduces wear on the members compared to scheduled rotation performed throughout the entire idle time. Each rotation of a member causes mechanical wear on the motor and bearings of the rotating member, and can cause surface wear on other member(s) the rotating member contacts. Therefore, rotation is preferably not performed unless it provides a benefit, e.g. reducing visible banding.

In step 250, the members are returned to the first position, within the tolerances described above. They are retained in the first position with respect to each other (within tolerances described above) for a third dwell time different from the first dwell time, and neither member is rotated during the third dwell time. The second dwell time is preferably long enough that the charge distributions on the surfaces of the members are the same after the second dwell time as they were before the first dwell time. That is, after the second dwell time, the conditions of the portions of the members that were in the charge-transfer region during the first dwell time are preferably not distinguishable electrically or mechanically from their conditions before the first dwell time.

After the third dwell time, steps 220-240 or 220-250 can be repeated (loop 255). In an embodiment, a different third dwell time is selected each time step 250 is reached. This provides an irregular rotation which can produce less EP engine wear and toner wear than scheduled rotation. In an embodiment, as the time since the last print increases, the charge on the toner is reduced due to charge transfer and leakage off the toner particles onto the members or other printer components capable of transferring charge. Therefore, the time between rotations, the third dwell time, is increased. This advantageously reduces EP engine wear without compromising banding-reduction performance by matching the frequency of rotation to the need for rotation, which is controlled by the strength of the electric field produced by the charged toner.

Various embodiments of the method of FIG. 1 can be employed for other purposes than reducing cross-track banding artifacts. In an embodiment, this method improves the flow of toner by periodically stirring the toner. This mixes toner particles of various charge levels to provide a more uniform first print after the third dwell time. In another embodiment, this method can be employed to replace scheduled rotation of rollers in an EP engine, as described above.

In another embodiment, the two members are in mechanical contact with each other at least one point and exert a force on each other at that point due to the pressure holding them together. At least one of the members is made of a soft material (e.g. a foam or viscoelastic foam) which undergoes mechanical deformation due to this force. Rotation according to FIG. 2 permits the members to relax mechanically through creep recovery since the first position is different than the second position, and therefore at least one point of contact in the first position is not a point of contact in the second position.

Figure 3:
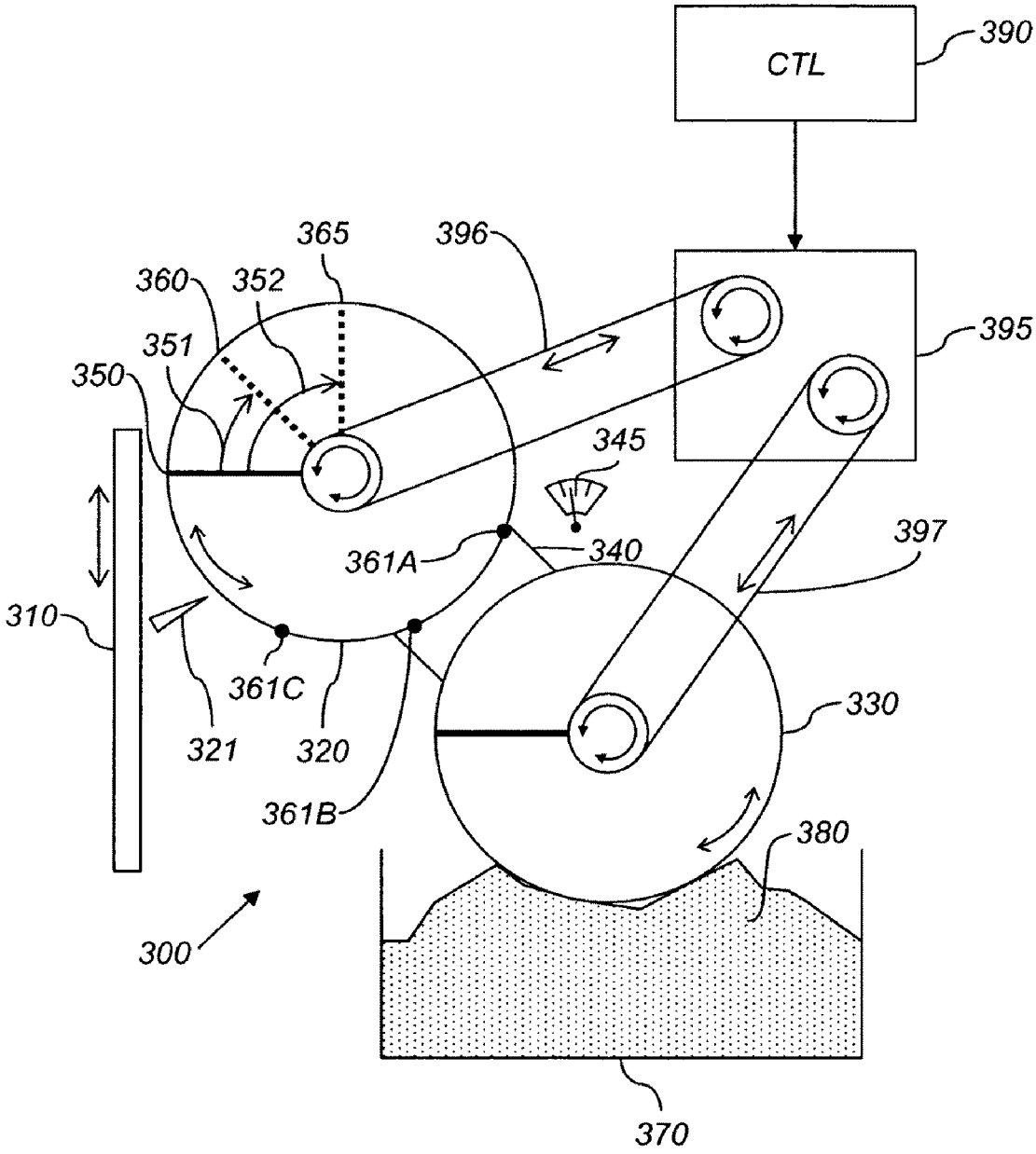
FIG. 3 is an elevational cross-section of an apparatus according to an embodiment of the present invention.

FIG. 3 shows a side elevation of an embodiment of an electrophotographic printing apparatus according to the present invention. Print engine 300 is adapted to apply or deposit toner 380 on a receiver (not shown) to form a print image. The print image is formed from a visible image on photoreceptor 310. Photoreceptor 310 can be a sheet, belt, or drum. Print engine 300 includes development member 320 and supply member 330 disposed so that toner and charge are transferred between the members in a charge-transfer region 340. Each member is a roller and is preferably substantially circular in cross-section.

Charge-transfer region 340 is not a physical part of print engine 300; it is a region of space in which the electric fields between development member 320 and supply member 330 are strong enough to move charge between the two. The rotation of supply member 330 and development member 320, in the presence of toner 380 in charge-transfer region 340, with the assistance of development blade 321, results in an approximately uniform coat of toner 380 on development member 320.

Development blade 321 mechanically levels the toner coat on development member 320 by scraping off any toner peaks farther from the surface of development member 320 than development blade 321. Charge-transfer region 340 has a higher charge density than other regions on supply member 330 and development member 320 because toner 380 on supply member 330 is tribocharged in this region. Supply member 330 collects toner 380 mechanically by van der Waal's forces, and electrostatically using a bias voltage which attracts residual charge or tribocharge on toner 380. Toner 380 is transferred from supply member 330 to development member 320 by electric fields due to respective, different bias voltages applied to supply member 330 and development member 320.

Controller 390 controls actuator 395, which in response to controller 390 selectively rotates members 320, 330 using belts 396, 397 respectively. Controller 390 determines the first dwell time and the second dwell time, as described above. It then retains the members for the first dwell time (step 220), causes actuator 395 to rotate one of the members (step 230), and retains the members for the second dwell time (step 240) and optionally the third dwell time (step 250).

Development member 320 is shown as it is oriented in first position 350, measured as 0° clockwise from the west compass point (a line extending from the axis of development member 320 to its left-hand edge, as viewed here). Supply member 330 is stationary, as shown by the corresponding line at 0°. The positions and 0° orientations compose the first position. The members 320, 330 are retained in this position with respect to each other for the first dwell time, and neither is rotated during the first dwell time. As a result, charge is transferred between members 320 and 330 in the charge-transfer region 340. For example, toner 380 which has been tribocharged exerts an electric field, as described above, driving electrons, ions or other particles having the same sign of charge away from charge-transfer region 340, as described above.

After the first dwell time has elapsed, controller 390 can cause actuator 395 to rotate development member 320 clockwise by 45° to second position 360, as shown by rotation 351. Point 361B on development member 320 is moved out of charge-transfer region 340 by rotation 351, to point 361C. Not all points formerly in charge-transfer region 340 are moved out of the region; point 361A is moved to where point 36113 formerly was, still inside the charge-transfer region.

Alternatively, after the first dwell time, controller 390 can cause actuator 395 to rotate development member 320 clockwise by 90° to second position 365, as shown by rotation 352. Point 361A on development member 320 is moved out of charge-transfer region 340 by rotation 351, to point 361C. All points formerly in charge-transfer region 340 are moved out of the region, as the region subtends less than 90° of development member 320.

The point being rotated out of charge-transfer region 340 can be located on the member being rotated or the member being held stationary. Both members can be rotated so that at least one point on one of the members is moved out of charge-transfer region 340. For example, rather than rotating development member 320 by angle θ, development member 320 and supply member 330 can both be rotated by θ/2 in opposite directions.

Toner 380 is supplied from toner supply 370 to supply member 330. Supply member 330 provides toner to development member 320. Development member 320 provides toner to photoreceptor 310, where it adheres to the appropriate parts of the latent image to form a visible image. The adhered toner is then transferred to a receiver (not shown) to form the print image.

In an embodiment, a supply of monocomponent developer adapted to be applied by the EP print engine to the receiver is provided. The developer comprises toner particles, and comprises less than 1% magnetic carrier particles.

In an embodiment, development member 320 and supply member 330 are belts entrained around members, as is known in the art.

Figure 4A:
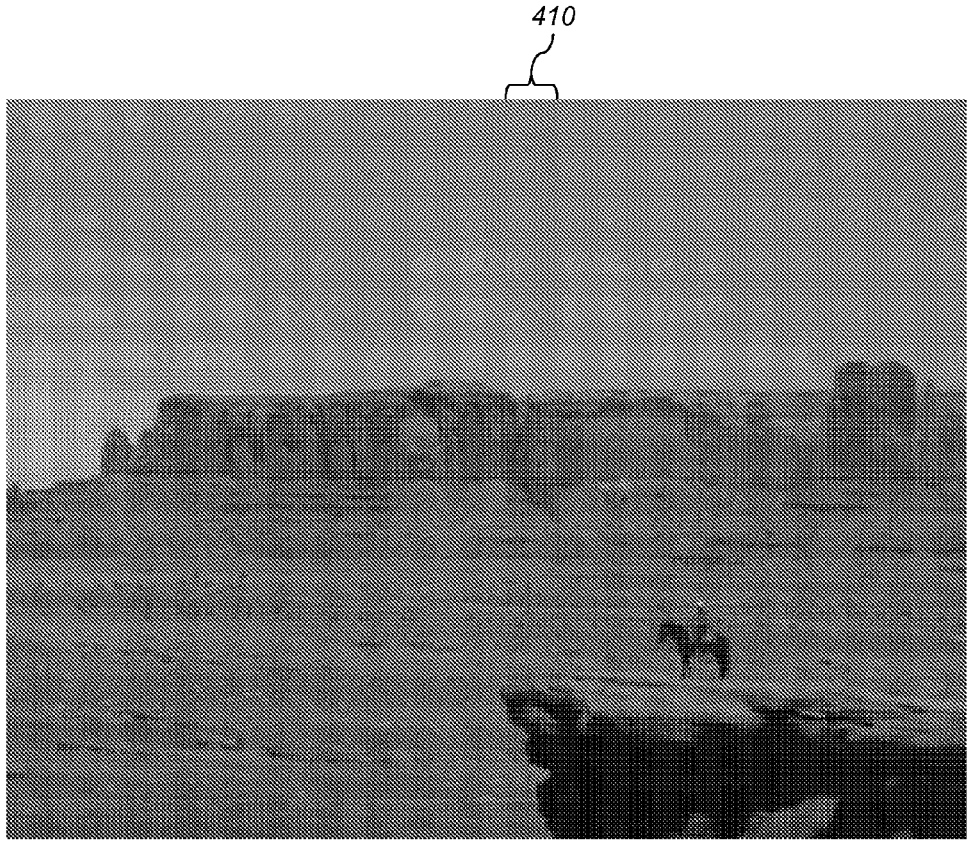
FIG. 4A is a graphical representation of a print showing a cross-track banding artifact.

FIG. 4A is a graphical representation showing a cross-track banding artifact due to nonuniform charge on the surfaces of the development and supply members. Banding artifact 410 is an area where more toner was developed onto the photoreceptor than desired. This is because charge pushed out of charge-transfer region 340 (FIG. 3) builds up in areas close to the edges of charge-transfer region 340, and therefore attracts more toner in those areas.

Figure 4B:
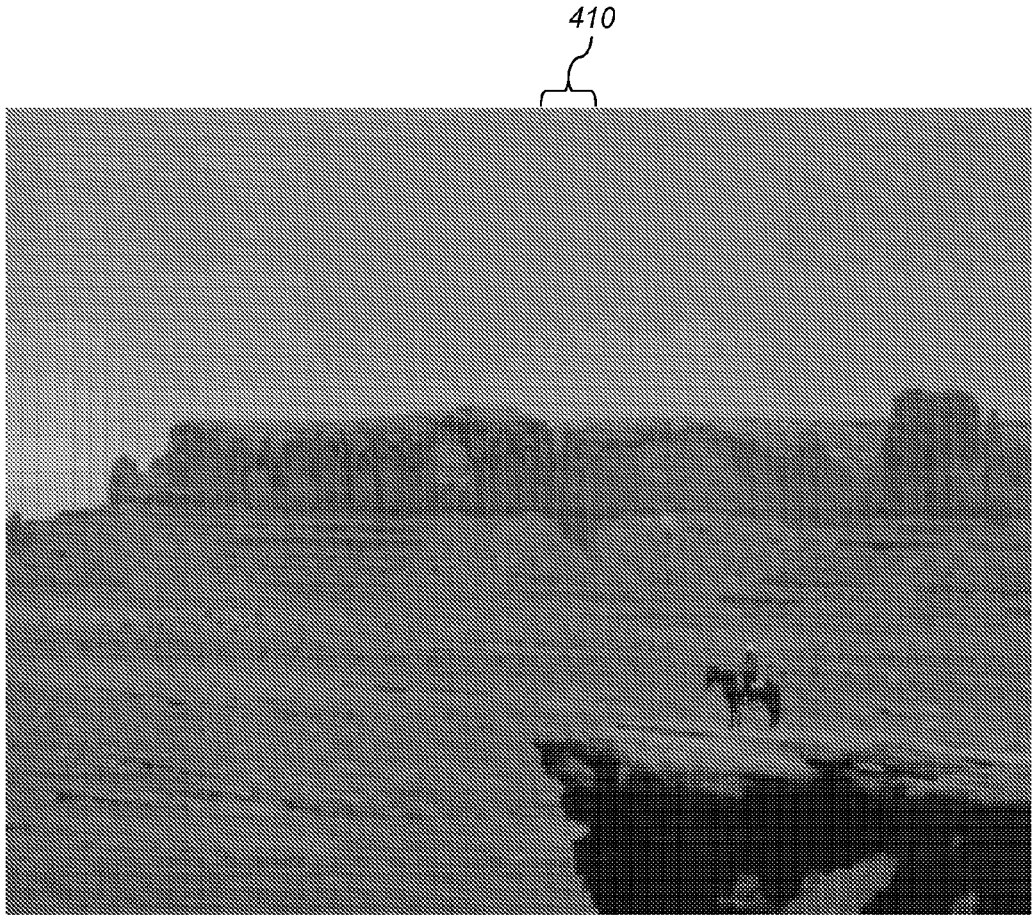
FIG. 4B is a graphical representation of a print showing reduced banding.

FIG. 4B is a graphical representation to which the method of FIG. 1 has been applied to reduce the banding artifact. In area 410, the nonuniformity is not visible.

Figure 4C:
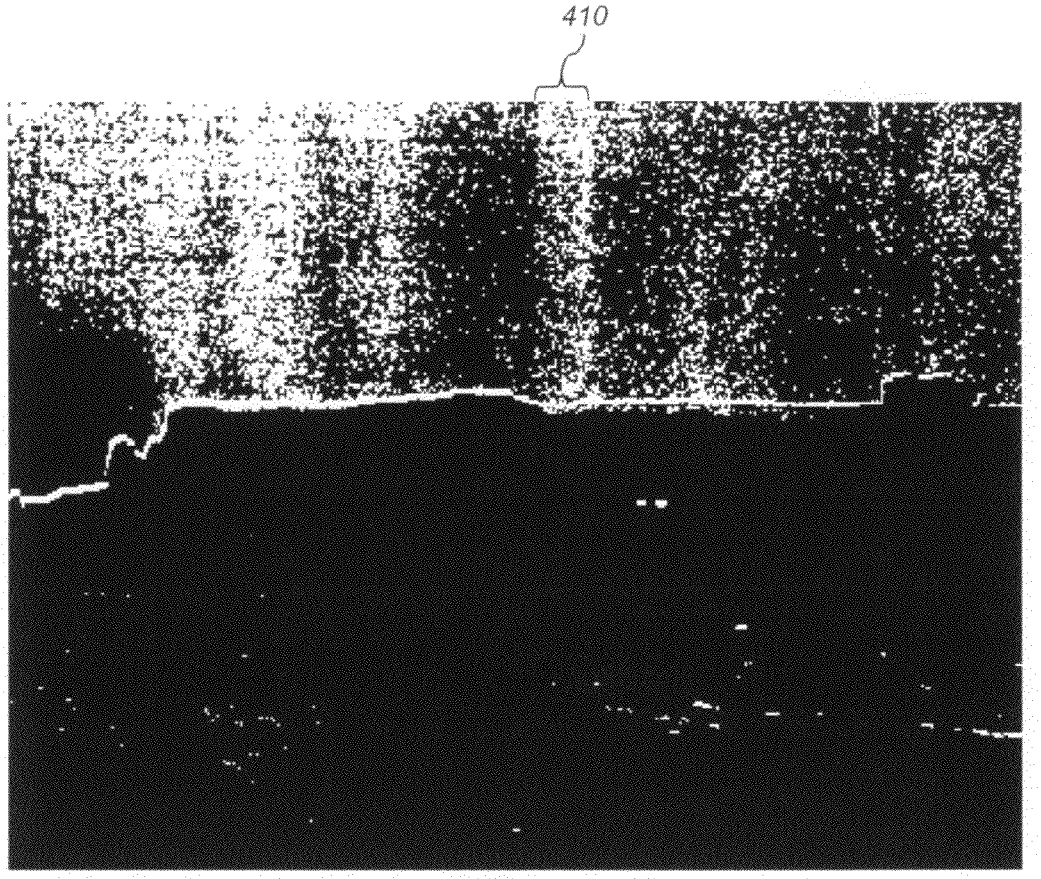
FIG. 4C is a computer-generated graphical representation of a comparison between FIGS. 4A and 4B.

FIG. 4C is a computer-generated graphical representation of a comparison between FIGS. 4A and 4B. ADOBE PHOTOSHOP 7.0.1 was employed to make this comparison. White areas are pixels that are different between FIGS. 4A and 4B. Area 410 shows that there is a difference between FIGS. 4A and 4B. Specifically, the nonuniformity present in area 410 of FIG. 4A is not present in area 410 of FIG. 4B. The correction of other banding artifacts can also be seen in FIG. 4C.

FIG. 4C is edited to more clearly show the differences between FIGS. 4A ("Before") and 4B ("After"). To create FIG. 4C, the images of FIGS. 4A and 4B were imported into ADOBE PHOTOSHOP. The Auto Levels, Auto Contrast, and Auto Color adjustments were applied to each image, in that order. The brightness of each image was adjusted by −28 and the contrast by +35. The Before image was skewed vertically at the left-hand edge by 0.6° to improve the registration of the two images. The color balance was adjusted with shadow values −100, −100, 0 and highlight values 0, +60, 0. These steps emphasized the nonuniformities in the sky, where the defect in area 410 is most visible. The After image was cropped at the bottom to have the same pixel dimensions as the skewed Before image.

The respective differences between the blue and green channels of the two images were then taken. The green channel of the Before image was subtracted from the green channel of the After image using Calculations. Source 1 was set to Before, Layer 0, Green channel; Source 2 was set to After, Layer 0, Green channel; the blending mode was Subtract with opacity 100%, offset 0, and scale 1. The result was placed in a new channel. The same was performed for the blue channels. The two resulting channels (Alpha 1 and 2) were then copied into the green and blue channels of a new RGB color image, respectively, and the red channel data was set to 0. The contrast of the resulting image was adjusted by +60. The curves for the RGB channels were adjusted by placing an anchor point at input=128, output=208. The image was thresholded at a threshold of 55. This produced the image of FIG. 4C, which clearly shows the effect of nonuniformity compensation.

Figure 5:
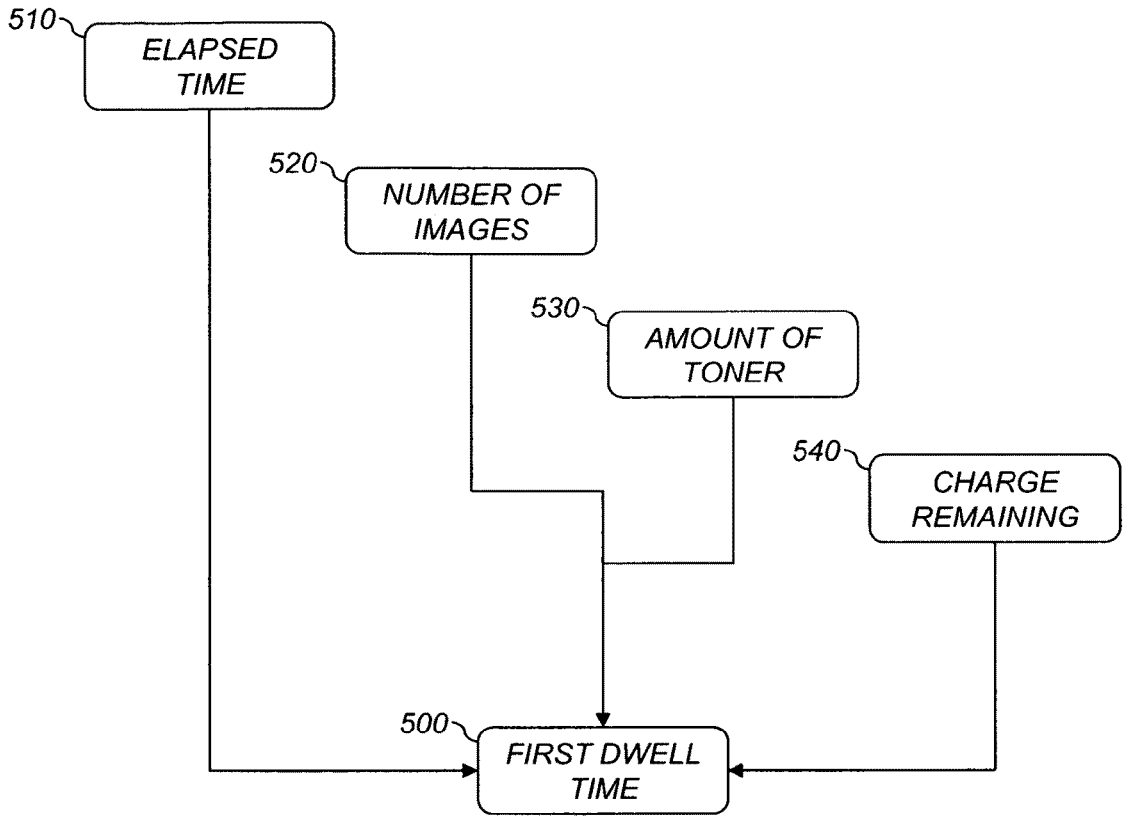
FIG. 5 is a dataflow diagram of factors useful with various embodiments of the present invention.

FIG. 5 shows a dataflow diagram of factors useful individually or in combination for determining the first dwell time 500. These factors can be tracked by controller 390 (FIG. 3). The first dwell time 500 can be determined based on the elapsed time 510 since the last image was printed (i.e. since the most recently-printed image was printed) or since print engine 300 went into an idle state. First dwell time 500 can also be determined based on the number of images 520 printed, as will be described further below. Referring also to FIG. 3, first dwell time 500 can also be determined based on the amount 530 of toner 380 remaining in toner supply 370, or on the charge remaining 540 on toner 380, development member 320, or supply member 330.

In embodiments in which a limited supply of toner 380 (FIG. 3) is provided to print engine 300 (e.g. by a toner cartridge), the first dwell time can be determined based on the amount 530 of toner 380 remaining in toner supply 370 (FIG. 3). For example, the first dwell time can be greater than or equal to one hour at the beginning of life of a toner cartridge, and less than or equal to one hour at the end of life of a toner cartridge. The second dwell time is greater than 30 sec. In various embodiments, the first dwell time is reduced as the amount of toner 380 remaining in toner supply 370 decreases.

In an embodiment, when a new toner supply 370 is installed in printer 100, a counter tracking toner usage (e.g. grams of toner applied to a receiver) is initialized. Toner usage is then tracked for each print by incrementing the counter. In high-toner usage scenarios (e.g. >10 photos printed per hour), first dwell time 500 is determined based on the amount 530 of toner 380 remaining in toner supply 370. In low-toner-usage scenarios, first dwell time 500 is determined based on the elapsed time 510 since the last image was printed (the "toner age").

Referring to FIGS. 3 and 5, in an embodiment, one or both of development member 320 and supply member 330 are line-replaceable units (LRUs). The members can also both be part of a larger LRU. Each LRU can be used in printing only a certain number of images before the image quality of print images degrades to levels unacceptable to a viewer of the print images. First dwell time 500 can therefore be determined based on the number of images 520 printed with the current LRU(s). In an embodiment, after a selected number of images have been printed using a member or LRU, the development member or the supply member, or containing LRU, is replaced.

In another embodiment, the charge remaining on toner 380, development member 320, or supply member 330 is measured by meter 345 (represented graphically as the face of a gauge). Meter 345 measures electric field strength or other factors correlated to residual charge. For example, meter 345 can include two conductors (not shown) having a high or infinite resistance between them. Meter 345 can measure the voltage between the conductors, which voltage is induced by movement of charge under the influence of electric fields in the vicinity of the conductors. Residual charge decreases over time due to charge leakage to other parts of printer 100, or out of printer 100 into the atmosphere or power-distribution grid. The first dwell time is preferably increased as the residual charge decreases, which maintains image quality and reduces wear.

Figure 6:
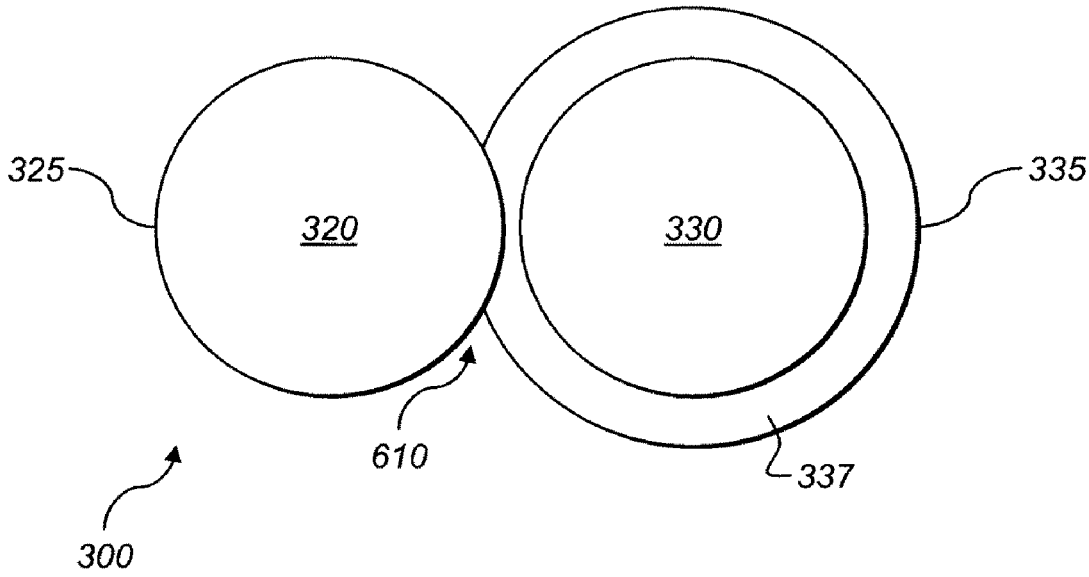
FIG. 6 is a side elevation of members according to an embodiment of the present invention.

FIG. 6 is a side elevation of members according to an embodiment of the present invention. Print engine 300 includes development member 320 with surface 325, and supply member 330 with surface 335. Surfaces 325 and 335 contact each other mechanically at least one point to form nip 610. Surface 335 is softer than surface 325, as measured e.g. with a Shore A durometer. In an embodiment, supply member 330 has a Shore A hardness of approximately 20, and development member 320 has a Shore A hardness of approximately 50. In an embodiment, surface 335 is the surface of a blanket 337, which can be a layer of foam or elastomer, disposed around supply member 330.

Figure 7:
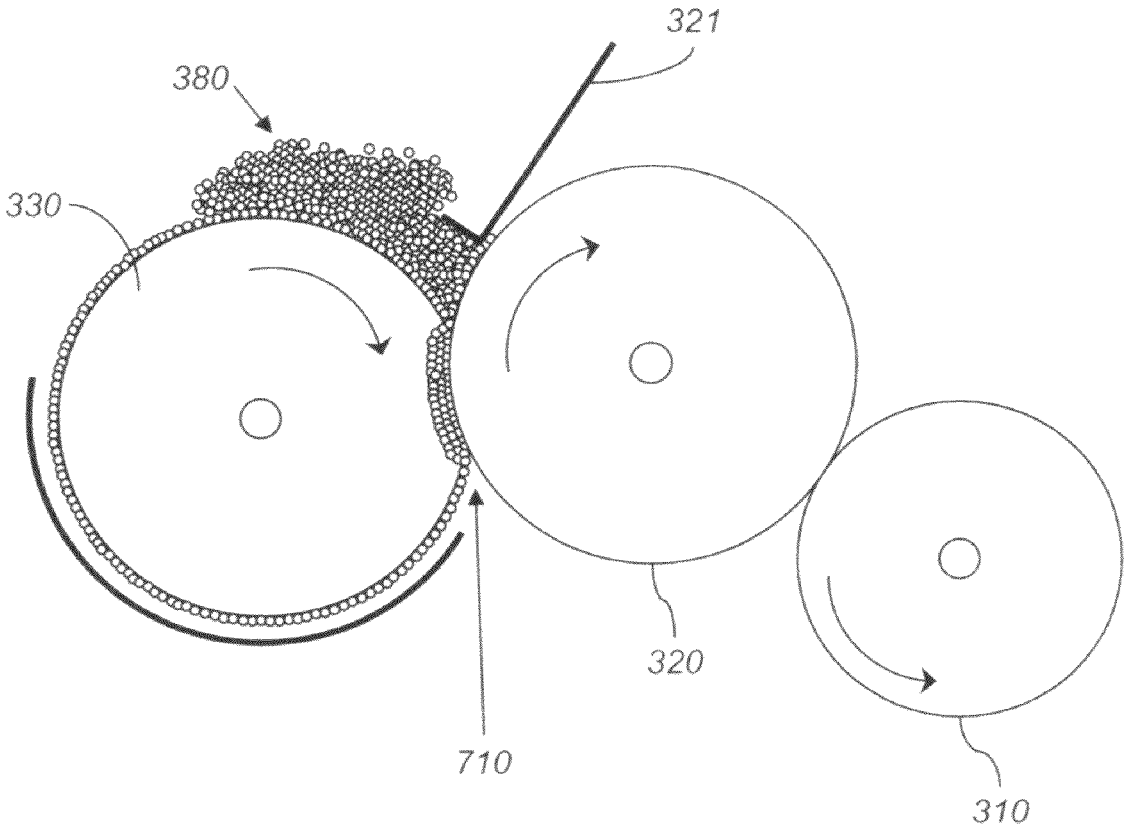
FIG. 7 is a side elevation of members according to another embodiment of the present invention.

FIG. 7 shows an elevation according to an embodiment. Supply member 330, development member 320, development blade 321 and toner 380 are as shown in FIG. 3. Photoreceptor 310 is a drum photoreceptor, i.e. a cylinder with a dielectric wrapped around it. At nip 710, toner is pressed between supply member 330 and development member 320. This causes mechanical deformation of supply member 330. Rotating according to various embodiments e.g. can relieve mechanical stress in addition to redistributing charge, advantageously reducing banding. Mechanical stress is relieved through creep recovery after a rotation as described above.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
40 supply unit
42 receiver
50 transfer subsystem
60 fuser
62 fusing roller
64 pressure roller
66 fusing nip
68 release fluid application substation
69 output tray
99 logic and control unit (LCU)
100 printer
101 transport web
106 cleaning station
210 step provide members
220 step retain members
230 step rotate member
240 step retain members
245 loop
250 step retain members
255 loop
300 print engine
310 photoreceptor
320 development member
321 development blade
325 surface
330 supply member
335 surface
337 blanket
340 charge-transfer region
345 meter
350 first position
351, 352 rotation
360 second position
361A, 361B, 361C point
365 second position
370 toner supply
380 toner
390 controller
395 actuator
396 belt
397 belt
410 banding artifact
500 first dwell time
510 elapsed time
520 number of images
530 amount
540 charge remaining
610 nip
710 nip

The invention claimed is:

1. A method of reducing cross-track banding artifacts and wear in an electrophotographic (EP) print engine adapted to print one or more image(s) on one or more receiver(s), the method comprising:

a) providing a development member and a supply member disposed so that charge is transferred between the members in a charge-transfer region; and performing the following steps in order:

b) retaining the members in a first position with respect to each other for a first dwell time that is greater than a time for one revolution of the development member, wherein neither member is rotated during the first dwell time, so that charge is transferred between members in the charge-transfer region and a cross-track banding artifact is produced on the development member, wherein the first dwell time is determined based on the number of the image(s) printed;

c) rotating one of the members so that at least one point on one of the members is moved out of the charge-transfer region, whereby the banding artifact is mitigated; and d) retaining the members in a second position with respect to each other for a second dwell time that is greater than the time for one revolution of the development member, wherein neither member is rotated during the second dwell time, so that wear on the EP print engine is reduced.

2. The method according to claim 1, further comprising:

e) retaining the members in the first position with respect to each other for a third dwell time different from the first dwell time, wherein neither member is rotated during the third dwell time.

3. The method according to claim 1, wherein each member is a roller or a belt.

4. The method according to claim 1, further including determining the first dwell time based on elapsed time since the most recent one of the image(s) was printed.

5. The method according to claim 1, further including replacing a selected one of the development member or the supply member after a selected number of image(s) have been printed using the selected member.

6. The method according to claim 1, further including providing a supply of monocomponent developer adapted to be applied by the EP print engine to the one or more receiver(s), wherein the developer comprises toner particles, and comprises less than 1% magnetic carrier particles.

7. The method according to claim 1, wherein the EP print engine includes a supply member and a development member for printing the one or more image(s) on the one or more receiver(s), and the surface of the supply member is softer than the surface of the development member.

8. The method according to claim 1, wherein step c further includes rotating one of the members so that all points on one of the members are rotated out of the charge-transfer region.

9. The method according to claim 1, wherein the at least one point is located on the member being rotated.

10. The method according to claim 1, wherein step c further includes rotating both members so that the at least one point on one of the members is moved out of the charge-transfer region.

11. The method according to claim 1, wherein each member is a roller and is substantially circular in cross-section.

12. A method of operating an electrophotographic print engine adapted to print one or more images(s) on one or more receiver(s), comprising:

a) providing a development member and a supply member disposed so that charge is transferred between the members in a charge-transfer region; and performing the following steps in order:

b) retaining the members in a first position with respect to each other for a first dwell time that is greater than a time for one revolution of the development member, wherein neither member is rotated during the first dwell time, so that charge is transferred between members in the charge-transfer region, wherein the first dwell time is determined based on the number of the image(s) printed;

c) rotating one of the members so that at least one point on one of the members is moved out of the charge-transfer region; and d) retaining the members in a second position with respect to each other for a second dwell time that is greater than a time for one revolution of the development member, wherein neither member is rotated during the second dwell time.

13. The method according to claim 12, further comprising:

e) retaining the members in the first position with respect to each other for a third dwell time different from the first dwell time, wherein neither member is rotated during the third dwell time.

14. The method according to claim 12, further including determining the first dwell time based on elapsed time since a last image was printed.

15. The method according to claim 1, further including replacing a selected one of the development member or the supply member after a selected number of image(s) have been printed using the selected member.

16. Electrophotographic printing apparatus for printing one or more image(s) on one or more receiver(s), comprising:

a) a development member and a supply member disposed so that charge is transferred between the members in a charge-transfer region, and a supply of toner, wherein the electrophotographic printing apparatus applies toner to the one or more receiver(s) to print the one or more image(s);

b) a controller for determining a first dwell time and a second dwell time, each of which is greater than a time for one revolution of the development member, wherein the first dwell time is determined based on the number of the image(s) printed, or based on an amount of toner remaining in the supply of toner;

c) an actuator responsive to the controller for selectively rotating one of the members; and d) wherein the controller is adapted to perform the following steps in order:

i) retain the members in a first position with respect to each other for the first dwell time, wherein neither member is rotated during the first dwell time, so that charge is transferred between members in the charge-transfer region;

ii) cause the actuator to rotate one of the members so that at least one point on one of the members is moved out of the charge-transfer region; and iii) retain the members in a second position with respect to each other for the second dwell time, wherein neither member is rotated during the second dwell time.

17. A method of reducing cross-track banding artifacts and wear in an electrophotographic (EP) print engine adapted to print one or more image(s) on one or more receiver(s), the method comprising:

a) providing a development member and a supply member disposed so that charge is transferred between the members in a charge-transfer region, and providing a supply of toner, wherein the EP print engine applies toner to the one or more receiver(s) to print the one or more image(s); and performing the following steps in order:

b) retaining the members in a first position with respect to each other for a first dwell time that is greater than a time for one revolution of the development member, wherein neither member is rotated during the first dwell time, so that charge is transferred between members in the charge-transfer region and a cross-track banding artifact is produced on the development member, wherein the first dwell time is determined based on an amount of toner remaining in the supply of toner;

c) rotating one of the members so that at least one point on one of the members is moved out of the charge-transfer region, whereby the banding artifact is mitigated; and d) retaining the members in a second position with respect to each other for a second dwell time that is greater than the time for one revolution of the development member, wherein neither member is rotated during the second dwell time, so that wear on the EP print engine is reduced.

18. A method of operating an electrophotographic print engine adapted to print one or more images(s) on one or more receiver(s), comprising:

a) providing a development member and a supply member disposed so that charge is transferred between the members in a charge-transfer region, and providing a supply of toner, wherein the EP print engine applies toner to the one or more receiver(s) to print the one or more image(s); and performing the following steps in order:

b) retaining the members in a first position with respect to each other for a first dwell time that is greater than a time for one revolution of the development member, wherein neither member is rotated during the first dwell time, so that charge is transferred between members in the charge-transfer region, wherein the first dwell time is determined based on an amount of toner remaining in the supply of toner;

c) rotating one of the members so that at least one point on one of the members is moved out of the charge-transfer region; and d) retaining the members in a second position with respect to each other for a second dwell time that is greater than a time for one revolution of the development member, wherein neither member is rotated during the second dwell time.

* * * * *